US011202730B2

(12) United States Patent
Lingegard

(10) Patent No.: US 11,202,730 B2
(45) Date of Patent: Dec. 21, 2021

(54) PATIENT TRANSFER AND TRAINING AID

(71) Applicant: ArjoHuntleigh AB, Malmo (SE)

(72) Inventor: Hans Lingegard, Eslov (SE)

(73) Assignee: ArjoHuntleigh AB, Malmo (SE)

( * ) Notice: Subject to any disclaimer, the term of this patent is extended or adjusted under 35 U.S.C. 154(b) by 251 days.

(21) Appl. No.: 15/555,687

(22) PCT Filed: Mar. 6, 2016

(86) PCT No.: PCT/EP2016/054719
§ 371 (c)(1),
(2) Date: Sep. 5, 2017

(87) PCT Pub. No.: WO2016/142309
PCT Pub. Date: Sep. 15, 2016

(65) Prior Publication Data

US 2018/0036189 A1 Feb. 8, 2018

(30) Foreign Application Priority Data

Mar. 6, 2015 (EP) ..... 15158076

(51) Int. Cl.
*A61G 7/10* (2006.01)
*A61H 1/00* (2006.01)
*A61H 3/04* (2006.01)

(52) U.S. Cl.
CPC ..... *A61G 7/1017* (2013.01); *A61G 7/1046* (2013.01); *A61G 7/1051* (2013.01);
(Continued)

(58) Field of Classification Search
CPC .. A61G 7/1017; A61G 7/1046; A61G 7/1051; A61G 7/1065; A61G 7/1092;
(Continued)

(56) References Cited

U.S. PATENT DOCUMENTS 1,709,410 A * 4/1929 Simmons ..... A61H 1/005 601/61
3,629,880 A * 12/1971 van Rhyn ..... A61G 7/1017 5/83.1

(Continued)

FOREIGN PATENT DOCUMENTS

EP 1029524 A2 8/2000
GB 2140773 A 12/1984

(Continued)

OTHER PUBLICATIONS

Japanese Decision of Rejection issued in JP2017-564950 dated Sep. 8, 2020.

*Primary Examiner* — David R Hare
(74) *Attorney, Agent, or Firm* — The Webb Law Firm

(57) ABSTRACT

A patient transfer and training aid includes a chassis to which a lifting unit is attached. The lifting unit includes a lifting arm assembly and an active foot support assembly fixed to the chassis. The device also includes a control unit which operates motors of the lifting arm assembly and the active foot support assembly. A patient can activate the foot support assembly to provide vibratory movement of the foot support assembly in order to provide muscle toning and training able to assist in the recovery and rehabilitation of the patient. The device can also be used to aid in the transfer of a patient from one location to another. The device can be used in a variety of different configurations to provide different forms of patient support and training.

21 Claims, 5 Drawing Sheets

(52) U.S. Cl.
CPC ..... *A61G 7/1065* (2013.01); *A61G 7/1092* (2013.01); *A61G 7/1096* (2013.01); *A61H 1/005* (2013.01); *A61H 3/04* (2013.01); *A61G 2200/34* (2013.01); *A61G 2200/36* (2013.01); *A61G 2203/10* (2013.01); *A61H 2201/164* (2013.01); *A61H 2201/1623* (2013.01); *A61H 2201/1635* (2013.01); *A61H 2203/0406* (2013.01)

(58) Field of Classification Search
CPC ..... A61G 7/1096; A61G 2203/10; A61G 2200/34; A61G 2200/36; A61H 3/04; A61H 1/005; A61H 2201/1623; A61H 2201/1635; A61H 2201/164; A61H 2203/0406
See application file for complete search history.

(56) References Cited

U.S. PATENT DOCUMENTS 4,086,921 A * 5/1978 Gonzales ..... A47C 16/025 601/22
4,809,804 A * 3/1989 Houston ..... A61G 5/1051 180/65.51
4,858,599 A * 8/1989 Halpern ..... A61H 1/005 601/105
4,918,771 A 4/1990 James
5,273,028 A * 12/1993 McLeod ..... A61F 2/28 601/35
5,309,584 A * 5/1994 Parker ..... A61G 7/1017 5/86.1
5,524,303 A * 6/1996 Palmer, Jr. ..... A61G 7/1015 5/507.1
5,530,976 A * 7/1996 Horcher ..... A61G 7/1015 182/3
5,892,180 A * 4/1999 Carey ..... A61G 7/1017 177/144
6,092,247 A * 7/2000 Wilson ..... A61G 7/1011 5/81.1 R
6,119,287 A * 9/2000 Phillips ..... A61G 7/1017 5/81.1 RP
6,389,619 B1 * 5/2002 Dunn ..... A61G 7/1017 5/81.1 R
6,440,046 B1 * 8/2002 Tholkes ..... A61G 5/14 280/250.1
7,356,858 B2 * 4/2008 Summers ..... A61G 7/1015 5/83.1
7,392,554 B1 * 7/2008 Su ..... A61G 7/1017 5/86.1
7,854,709 B2 * 12/2010 Neff ..... A61H 1/005 601/104
7,921,486 B2 * 4/2011 Biersteker ..... A61G 7/1017 5/87.1
8,650,677 B2 * 2/2014 Altena ..... A61G 5/14 5/81.1 R
9,009,886 B2 * 4/2015 Hjort ..... A61G 7/1019 5/83.1
9,364,379 B2 * 6/2016 Hammond ..... A61G 7/1017
10,238,564 B2 * 3/2019 Fakhrizadeh ..... A61G 7/1046
2003/0073550 A1 * 4/2003 Hsu ..... A63B 23/085 482/142
2003/0225348 A1 * 12/2003 Chen ..... A63B 22/16 601/28
2005/0217025 A1 * 10/2005 Barattia ..... A61G 7/1015 5/86.1
2007/0232965 A1 10/2007 Talish
2009/0119835 A1 * 5/2009 Liljedahl ..... A61G 5/00 5/87.1
2009/0249544 A1 * 10/2009 Palay ..... A61G 5/14 5/83.1
2015/0190293 A1 7/2015 Hacikadiroglu et al.

FOREIGN PATENT DOCUMENTS

GB 2318329 A 4/1998
JP 2008500130 A 1/2008
WO 2005115298 A1 12/2005
WO 2012130930 A1 10/2012

* cited by examiner

PATIENT TRANSFER AND TRAINING AID

CROSS-REFERENCE TO RELATED APPLICATIONS

This application is the United States national phase of International Application No. PCT/EP2016/054719 filed Mar. 6, 2016, and claims priority to European Patent Application No. 15158076.8 filed Mar. 6, 2015, the disclosures of which are hereby incorporated in their entirety by reference.

1. Technical Field of the Disclosure

The present disclosure relates to a patient transfer and training aid for the assisted mobility and transfer of people in daily life within community care, residential or nursing homes, hospital and medical facilities and institutional care as well as for mobility training, physical therapy and rehabilitation.

2. Background of the Disclosure

It is well known to provide walkers to assist elderly or infirm people to walk. These walkers generally include a frame-like structure mounted on wheels. The frame-like structure includes handles or a handle bar which a user can take hold of. Such walkers can be used by persons who are able to raise themselves to a standing position and who are capable of assisted walking. These walkers, however, have no dynamic foot support adapted for muscle or balance training.

It is also well known to provide mobile invalid hoists to assist individuals that are unable to stand and/or walk unaided. Such hoists can facilitate raising a patient to a standing or substantially standing position and support the patient in such a position while the patient is transferred from one location to another. Conventional invalid hoists generally include a mobile chassis, a support structure upstanding from the chassis, a lifting arm arrangement projecting from the support structure and providing laterally spaced attachment points for the attachment of a body support sling positioned around the back of a seated patient below the patient's arms and a lifting mechanism for raising the lifting arm and patient to a standing position. One such hoist is disclosed in GB-A-2,140,773. While such hoists may occasionally have a static footrest, as illustrated in GA-A-2,140,773, such static footrests provide no dynamic therapy for muscle and balance training.

The applicant has previously developed patient lifting and transport devices, some described in EP-1,029,524 and GB-2,318,329. These devices are particularly suitable for use by persons who are capable of raising themselves to a standing position but who are incapable of walking even when aided by a walker. The devices disclosed in GB-2,318,329 include a mobile chassis, a support structure upstanding from the chassis, a footplate supported by the chassis, a knee abutment above the footplate, hand supports supported by the support structure and two seat parts movable between inoperative positions in which a seated person can take hold of the hand supports and raise himself to a standing or substantially standing position on the footplate and operative positions behind the seat of the person when standing so that the person can be supported by the seat parts with his feet on the footplate and his knees against the knee abutment. As patient lifts and transport devices, these apparatus are very successful.

The present disclosure relates to improvements to these devices and similar devices to allow for both patient transport and the effective muscle training of a patient, leading to improved patient recovery.

SUMMARY

According to an exemplary embodiment of the present disclosure, there is provided a patient transport and training device including a mobile chassis for transporting a user, a support structure extending upwards from the chassis, at least one handle extending from the support structure for moving the device and a foot support assembly. The foot support assembly includes a powered footplate member which vibrates when actuated. This vibration may be used to deliver dynamic vibrational therapy to a user positioned on the footplate member.

The device can provide simultaneous lifting, support, transport and allow for balance and/or muscle training of a patient to enhance patient recovery and mobility.

The device may include a control unit to control operation of the driven footplate member and/or lifting mechanism. In one embodiment, the control unit includes a user input element and may provide for variable control on the basis of inputted commands.

A leg support of the device may be detachable and/or retractable to an inoperative position.

The device in an exemplary embodiment includes a powered lifting mechanism which includes at least one lifting arm assembly and an actuating device operative to raise and lower the lifting arm assembly. The lifting arm assembly may be pivotable about first and second axes, the first axis being substantially fixed and being further from the projecting end of the lifting arm than the second axis, wherein in use the actuating device raises and lowers the lifting arm.

The device may include a guide path generally upwardly inclined in an in use direction away from the person being lifted. The guide path may be rectilinear, curved, S-shaped or substantially S-shaped.

Advantageously, there is provided a sling connectible to the lifting mechanism to at least assist in raising a seated person to a standing or substantially standing position.

The device may include a hand grip or grips for supporting the arms of a person to be lifted.

In one embodiment, the lifting mechanism includes two lifting arms both of which are pivotally connected to the arm support. The two arms are advantageously arranged so as to move the arm support from a position in which it is upwardly inclined in an in use direction away from a person to be lifted to, or towards, a position in which it is substantially horizontal as the arm support is raised by the lifting mechanism.

In another embodiment, the lifting mechanism includes one or more lifting arms, each lifting arm including a user arm support connected thereto.

Advantageously, one or each of the hand support is provided at or adjacent to the upper end of the upstanding support structure.

The foot support assembly may include a single footrest or a pair of footrests, with common or separate driven footplate members. In one embodiment, the powered footplate member is detachably connectable to the device. The footplate member may have a cantilevered configuration. In another embodiment, the footplate member may be in direct contact with the ground and/or may be detachably connected to and/or supported by a footplate base. Optionally, the footplate base may include one or more wheels to facilitate mobility. In one embodiment, the footplate member may be movably connected to the device, wherein it may be moved from a first position in which it is extended to receive and/or support a user and a second position in which the footplate member is retracted within a space of the mobile chassis and/or support structure for storage. A motor for driving the footplate member may be positioned within a space defined in part by the footplate base, support structure and/or mobile chassis.

The support structure may be adjustable in length so that it can be adjusted to suit the height of a user.

Conveniently, the chassis includes two parallel or substantially parallel legs each supporting a wheel or castor at or adjacent each end, the legs being spaced apart by a lesser distance at their rearward ends than at their front ends to enable the rear ends of the legs to pass inside chair legs or a wheelchair.

According to an exemplary embodiment of the present disclosure, there is presented a method for using a transport and training device. The device includes a mobile chassis for transporting a user and a foot support assembly including a powered footplate member which vibrates when actuated. The method involves activating the powered footplate member to vibrate when a user's foot is positioned on the powered footplate member. The footplate member may be driven to vibrate at a frequency between about 5 to about 40 Hertz and/or at an amplitude of between about 1 to about 5 mm. The footplate member may also vibrate at a steady state or varying vibrational frequencies and/or amplitudes.

During use, the user may be seated in a chair adjacent to device, and the user's feet may be positioned on the powered footplate member and the user may directly engage the hand grips of the device while the footplate member is vibrating. The method may further involve raising a user from a sitting to a standing position using a powered lifting mechanism of the device. A leg support of the device configured to abut a user's leg may be retracted after the user has attained a standing position. The method may further involve the user standing on the vibrating footplate member for therapeutic use. A sling may optionally be secured about the user's torso while he is standing on the vibrating footplate member. The user may also engage handgrips of the device while standing on the vibrating footplate member. The user may also stand on the vibrating footplate member while unsupported by a sling or other component of the device and without holding onto the hand grips. The method may further involve simultaneously transporting a user between two locations while he/she is standing on the vibrating footplate member. In an exemplary embodiment, the method may further involve strengthening a user's muscles, improving a user's balance and/or improving, preventing the incidence of or treating a muscle or balance disorder or defect by using the device. The method of the may be accomplished using any of the transport and training aids described herein.

Other features and advantages will become apparent from the description which follows.

BRIEF DESCRIPTION OF THE DRAWINGS

Embodiments of the present disclosure are described below, by way of example only, with reference to the accompanying drawings, in which.

DESCRIPTION OF NON-LIMITING ILLUSTRATIVE EMBODIMENTS

Figure 1:
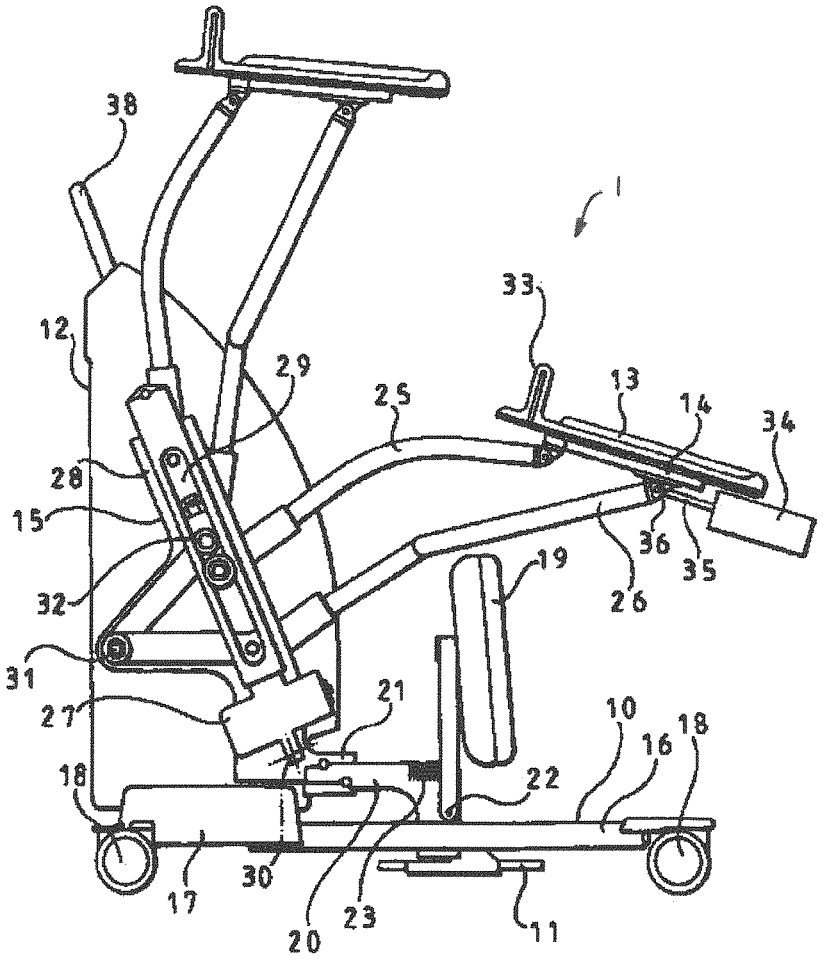
FIG. 1 is a side view of an example embodiment of a patient transfer and training aid.

Referring first to FIG. 1, the multifunctional patient transfer and training device 1 shown therein includes a mobile chassis 10, an active foot support assembly 11, a support structure 12 upstanding from the chassis 10, two arm supports 13 mounted on an inverted U-shaped bracket 14 and a lifting mechanism 15 for raising and lowering the arm supports 13.

The chassis 10 comprises two legs 16 (the second leg is not visible in the side view of FIG. 1) extending from and connected by a cross member or base 17. The legs 16 are provided with castors 18 at opposite ends and are pivotable relative to the base 17 from a position as shown and in which they are in parallel spaced relationship to a position in which they diverge towards their free ends. Main body or support structure 12, configured as a lifting unit, may be integral with, form part of and/or connected to base 17.

Two leg supports or knee abutments 19 are supported by arms 20 which are detachably connected to a bracket 21 mounted on the chassis 10. The knee abutments 19 are pivotally connected to the arms 20 about a horizontal axis 22 and are urged into a vertical or substantially vertical position (as shown in FIG. 1) by compression springs 23. The active foot support assembly 11, illustrated and described in greater detail in the embodiment of FIGS. 3-8 below, may be integral with or detachably connected to the arms 20. In one embodiment, the active foot support 11 can be independently attached or removed on its own from the patient transfer and training device. When connected to the device (e.g. attached to base 17 and/or support structure 12) and activated, foot support 11 functions to dynamically move and vibrate, which in turn moves and vibrates a person standing on active foot support 11. Thus operated, foot support 11 may be used as a therapeutic device for providing foot, leg and/or whole body vibration to an individual for strengthening his/her feet and legs. This therapy may be delivered while the patient lift and transfer device is stationary or during transport. In its non-operational mode, foot support 11 provides a static surface for supporting and transporting a patient. In another embodiment, the active foot support 11 may be connected to knee abutments 19 can be attached to and removed from the patient lift and transfer device as a single unit. In one embodiment, foot support 11 and knee abutment 19 can be simultaneously vibrated. When foot support 11, either alone or together with knee abutment 19, is detached from the patient lift and transfer device, the lifting device can be used as another type of rehabilitation aid, namely a patient lift and/or a walking support aid. In yet another embodiment, foot support 11 and/or knee abutment 19 the patient transfer and training device may be retractable into base 17 and/or support structure 12 when not in use. The base of support structure 12 may include a cavity into which active foot support 11, alone or together with knee abutment 19, may in a first state be retracted and stored when not in use. In a second state, foot support 11 and/or knee abutment 19 may be extended from base 17 and/or support structure 12 and locked it its extended position to securely support a person thereon.

The lifting mechanism 15 includes two lifting arms 25 and 26, a power driven linear actuator 27, typically a motor driven hydraulic actuator of the type made and sold by Smiths Industries Limited as a Single Acting Electrohydraulic Actuator 102740, and two spaced apart guide plates 28 (the second guide plate is not visible in the side view of FIG. 1).

The guide plates 28 are secured between the chassis 10 and the upper end of the support structure 12. Each guide plate 28 has an elongate guide slot 29. In the embodiment shown, these are rectilinear slots, but they could be curved or S-shaped slots. The slots 29 are upwardly inclined in a direction away from a person to be lifted. In one embodiment, the slots 29 could be so arranged that the person being lifted is initially moved in a generally forwards direction and then in a generally upwards direction.

The actuator 27 is pivotally connected at its lower end about a horizontal axis 30 between the two guide plates 28.

The lower lifting arm 26 is bifurcated at its projecting end where it is pivotally connected to the bracket 14 and is pivotally connected at its other end about a pivot pin 31 supported by the upstanding support structure 12. The lower lifting arm 26 is also pivotally connected to the extendible part of the actuator 27 and has two rollers 32 which are located in the two guide slots 29 (the second guide slot is not visible in the side view of FIG. 1), respectively. The upper lifting arm 25 is pivotally connected at its projecting end to the bracket 14 and at its other end to the extendible part of the actuator 27.

It will be appreciated that as the lower lifting arm 26 is pivotally connected about both the pin 31 and to the extendible part of the actuator 27, there is some provision for limited movement of this lifting arm 26 relative to one of these two pivots. This limited movement is provided relative to the pivot pin 31 by an elongate slot in the lower lifting arm 26 for receiving the pivot pin 31.

Pivoting the lower lifting arm 26 about the extendible part of the actuator 27 as well as about the pivot pin 31 and guiding the rollers 32 along the guide slots 29 has the effect of flattening out the arc through which the outer end of the lifting arm 26 would otherwise pivot if it was pivoted only about the pivot pin 31. The bracket 14 is thus raised along what approximates to a rectilinear path to thereby closely mimic the way in which a person stands when lifting himself from a seated position using downward pressure of his hands on the armrest of a chair. This is in contrast to the hitherto known practice of lifting a person along an arcuate path and is considered to provide a more comfortable lift.

The two lifting arms 25 and 26 could form a parallelogram linkage between the actuator 27 and the bracket 14, but may be arranged to move the bracket 14 and thereby the arm supports 13 from a position in which they are upwardly inclined in an in use direction away from a person to be lifted to, or towards, a position in which they are substantially horizontal as the brackets 14 and arm supports 13 are raised by the lifting mechanism 15. This is achieved by spacing the pivotable connections between the two arms 25 and 26 and the bracket 14 closer together than the pivotable connections between the two arms 25 and 26 and the actuator 27 and has the advantage that the lifting device can raise and lower a taller person to a standing or substantially standing position than would otherwise be the case with lifting arms of the same length.

The arm supports 13 are generally L-shaped to support the forearms and at least part of the upper arms of a person to be lifted. Each arm support is provided with a hand grip 33 and the position of each hand grip 33 may be adjustable so that the elbow of the person to be lifted can rest in contact with the junction between the two limbs of the generally L-shaped arm supports 13. The arm supports 13 are shaped to cradle the person's arms and are padded to give added comfort.

Releasable straps (not shown), typically having hook and loop fastening means, may be provided on the arm supports 13 to hold the arms of the person firmly in place.

A sling 34 is also provided. The sling 34 is made of a woven fabric material and a central part of the sling 34 may be padded for comfort. The sling 34 has a cord 35 at each end and the bracket 14 is provided with two jamb cleats 36 (shown in FIG. 2) for receiving the two cords 35, respectively. This allows the effective length of the sling 34 to be adjusted.

An adjustable strap (not shown) may be provided between the free ends of the arms of the bracket 14 to prevent a person to be lifted falling into the bracket 14.

One or more handles 38 may be provided at the upper end of the support structure 12 to allow an attendant to wheel the lifting device over the floor. In the embodiment shown in FIG. 1, two handles 38 (second obscured by the first handle) may be located at an upper end of support structure 12 which an attendant may grip with both hands to steer and direct movement of the transport and training device 1.

Figure 2:
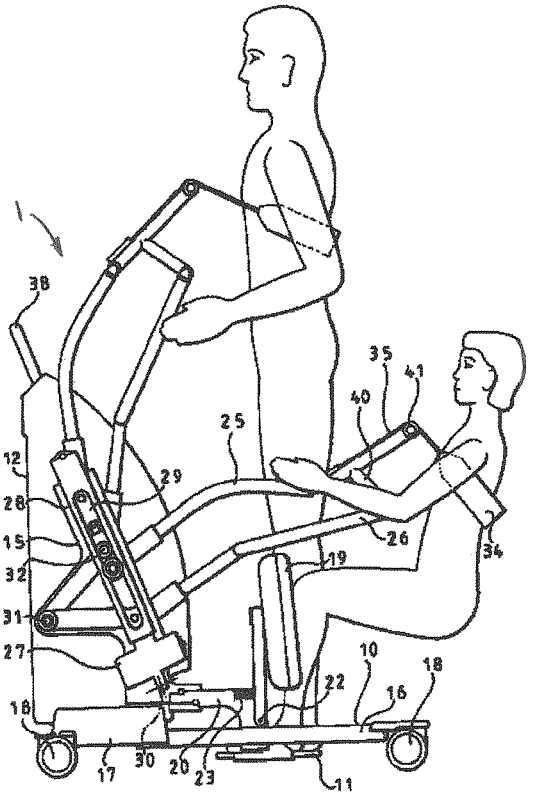
FIG. 2 is a side view of the device of FIG. 1 showing a person holding the transfer and training aid in the process of raising him/herself to a standing position.

Referring now to FIG. 2 of the drawings, the lifting device shown therein differs from the device shown in FIG. 1 in that the arm supports 13 and bracket 14 have been replaced by a sling support 40 which is pivotally connected to both the upper and lower arms 25 and 26. The sling support 40 has two laterally spaced apart sling attachment points 41 for supporting the sling 34 passing around the back and below the armpits of a person to be lifted. In this case, the person is supported solely by the sling.

In use, the multifunctional patient transfer and training device may be positioned adjacent to a seated person with the legs 16 of the chassis 10 straddling opposite sides of a chair on which a person to be lifted is seated. To lift the patient to a standing position, the person may places his/her feet on the foot support 11 with his/her knees against the knee abutments 19. The person then places his/her arms in the arm supports 13 and takes hold of the hand grips 33. The releasable straps (if provided) can then be secured in place around the arms by a nurse or other attendant. The sling 34 is then placed around the lower back of the seated person and connected to the jamb cleats 36. The arm supports 13, which provide upper body control and prevent the person swaying from side to side, are then raised. As the person is raises to a standing position, the knee abutments 19 pivot against the urging force of the springs 23 so that the knees of the patient move slightly forwards. As the person reaches a standing or substantially standing position, the springs 23 urge the knee abutments 19 and the knees of the person being lifted rearwards. In this initial standing position on foot support 11, the device may be used to transport the patient. Engaging gripping handle 38, an attendant or caregiver can push, pull and otherwise direct movement of the device to transport the patient to a desired location.

When the transport and training device is to be used as a rehabilitation aid to help a person practice walking, in one mode the foot support 11 may be removed and/or retracted into the base of support structure 12 before the patient is lifted. Once the person has been lifted to a standing position, the knee abutments 19 may be removed and/or retracted into the base of support structure 12 to create clearance for the patient to walk. The device may thus be used as a walking aid while the patient holds and is supported by arm support 13 and/or sling 34.

In another therapy mode, the transfer and training device may be used to provide balance and/or muscle training. For example, a patient seated in a wheelchair or arranged in a seated positioned adjacent to the device may place one or both feet on foot support 11. The knee abutments 19 may be removed and/or refracted in to support structure 12, and legs 16 may be pivoted to taper away from base 17 and foot support 11 during such therapeutic use to provide additional space to accommodate a patient's legs and feet. Thus situated, the vibrations of foot support 11 function to strengthen the lower leg muscles of a patient while the patient is seated. The patient may also rise to a standing position and use foot support 11 as a muscle strengthening and balance training aid. As foot support 11 vibrates, the patient may engaging arm support 13 and hand grip 33 for support. Optionally, sling 34 may also be secured around the patient's back for added support. Knee abutments 19 may be removed and/or retracted in to support structure 12 to provide additional space during therapeutic use or alternatively, may be extended to help position or support the patient. For advanced balance and muscle training, the patient may also remove and/or let go of all supports (e.g. knee abutments 19, sling 34, arm support 13, hand grip 33). The device also allows for transport of a patient while simultaneously undergoing balance and muscle training if desired.

Referring now to FIGS. 3 to 8, another embodiment of the transfer and training aid is illustrated. The active foot support assembly 111 of the transfer and training aid may described in greater detail below may be able to provide exercise and muscle conditioning for patients and may also be incorporated in the transfer and training device of FIGS. 1-2. This can enable a weak patient to recover faster and to build strength and balance, while also providing the lifting and holding support of the apparatus. It is to be understood that the teachings herein are not limited to the precise structure of the apparatus shown in FIGS. 1 and 2 and could equally be incorporated into similar patient lifting and transit devices, for instance of the type disclosed in the applicant's earlier GB-2,318,329, herein incorporated by reference in its entirety. In one embodiment, the knee support is retractable or movable, which allows for the patient to stand without pressing on the knee support when this is no longer necessary or not required for the active foot support function.

FIGS. 3 to 8 show an example patient transfer and training aid which has some slight differences with respect to the embodiment shown in FIGS. 1 and 2. In particular, in the embodiments of FIGS. 3 to 8, the transfer and training aid 100 has a lifting mechanism similar to and/or the same as the lifting mechanism 15 of FIGS. 1-2. The lifting mechanism of the embodiment shown in FIGS. 3-8 include a lifting arm assembly 115 and actuator for moving the lifting arm assembly 115 to assist in moving a patient between a seated and standing position. Lifting arm assembly 115 includes a pair of lifting arms 125 rather than the double trapezoidal lifting arm arrangement of FIGS. 1 and 2. Lifting arms 125 are linked to one another by a common cross-member forming a U-shaped configuration, which in turn is connected to a rod element 126 which is coupled to a lifting motor (not shown) within the main body or support structure 12. Rod element 126 moves along the vertical slot extending from a lower end to an upper end of support structure 12 to assist in lifting a patient. The free ends of lifting arms 125 may be connected to a pair of arm support members 124 configured for patient engagement. Arm support members 124 may be pivotally and/or fixedly jointed to lifting arms 125. In one embodiment, the left and right arm support members 124 may be pivotally connected to lifting arms 125 so as to enable a user to independently and freely position arm support members 124 relative to one another, thereby facilitate his grip on device 100 and overall stability. A patient may rest his forearms on arm support members 124 while gripping a pair of handles 152 extending vertically upwards therefrom. Handles 152 may in some embodiments include input elements for a control unit 150, such as switches, dials and the like. A distal end of arm support members 124 may be connected to one another via a cross-member forming a U-shaped frame; in one embodiment the U-shaped frame of arm support member 124 may mirror the U-shaped frame of lifting arms 125. In an example embodiment, handles 152 and/or control unit 152 may be mounted to and extended upwards from the cross-member of arm support member 124. In another embodiment, arm support members 124 and connecting cross-member may be replaced by a platform having a U shaped tray or plate like configuration for engaging a patient. Handles 152 and/or control unit 152 may be mounted thereto. In other embodiments transfer and training device 100 may have a trapezoidal arm arrangement similar to or the same as the example shown in FIGS. 1 and 2. Lifting arm assembly 115 of the embodiment of FIGS. 3-8 as well as the lifting arm assembly of FIGS. 1-2 is motorized to facilitate movement of a patient from a seated to a standing position.

As will become apparent below, the lifting arms 125 can be lowered and raised in order to support and assist a patient, in a manner very similar to the examples of FIGS. 1 and 2. It is not excluded, though, in other embodiments, that the apparatus 100 could be provided with a fixed arm arrangement with hand grips of a type as disclosed in GB-2,318,329.

Figure 3:
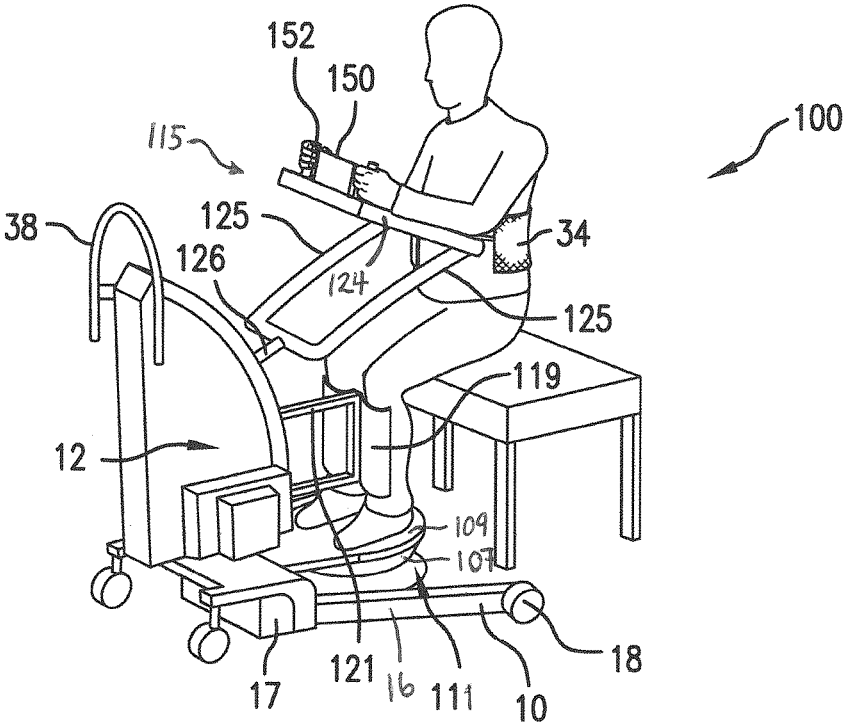
FIG. 3 is a schematic perspective side view of another example embodiment of a patient transfer and training device showing a patient engaging the device in a seated position wherein the patient's torso is supported by a sling and his lower extremities engage the leg support/knee abutments and a portion of the active foot support assembly.

As best shown in FIG. 3, apparatus 100 may also have a leg support or knee support 119 including one or two knee and/or leg support pads for supporting the patients' knees, shins and/or lower leg. In one embodiment, the knee support 119 may have the same or a structure similar to the knee support 19 of the example of FIGS. 1 and 2. In the embodiment illustrated in FIG. 3, knee support 119 may have a configuration similar in structure and/or functionality as knee support 19, wherein the knee support 119 has two equally be separate contoured pads for engaging a patient's shins The two contoured pads of knee support 119 may be attached to a support element 121 which allows the knee support 119 to be height adjustable and may further be moved backwardly and forwardly and in particular to be moved between an engagement position and a retracted position, in which it will not support a patient's knees, particularly useful to provide additional space for accommodating a patient's feet and legs when using the active foot support assembly, as described in further detail below. In one embodiment, the pads of knee support 119 may be folded together about support element 121 and retracted into support structure 12, such as the longitudinal slot or cavity illustrated in FIG. 4, for storage when not in use. In another embodiment, support element 121 may be retracted within the slot, while knee support 119 arranged in an open configuration to receive a patient's shins is positioned exterior to and adjoining the patient facing surface of support structure 12 to allow for ready use when knee support 119 is needed by a patient.

The apparatus 100 includes a frame or chassis 10 and a main body or support structure 12, configured as a lifting unit, with attendee gripping handle 38, all having a structure and characteristics the same as or similar to the example of FIGS. 1 and 2. As better illustrated in FIG. 3, attendee gripping handle 38 may have a U shaped configuration spanning and arching over and about the upper end of support structure 12 to facilitate gripping and movement of transfer and training aid 100. As the skilled person will appreciate, the frame, support structure and attendee gripping handle may also have a structure and characteristics similar to the device disclosed in GB 2,318,329 in other embodiments, or any other suitable framework or structure which enables a patient to be assisted from the sitting position to standing or semi-standing position and then to be transferred from one location to another on the device 100.

The apparatus 100 includes an active foot 111 which functions to provide physical therapy to a user, such as by strengthening a user's muscles and/or improving balance. The same or similar components, structure, features and functionality of foot support 111 described below may be incorporated in active foot support 11 FIGS. 1 and 2. As illustrated in FIGS. 3-8, active foot support assembly 111 may include one or more patient engaging, top plate, hereinafter referred to as footplate member 109, (seen best in FIGS. 4, 6 and 8) which is driven by a motor (not shown) within the foot support assembly 111 and which can be actuated to move or vibrate. In one embodiment, active foot support assembly 111 may include one or two powered footplate members 109, which may have a common actuator and/or separate actuators for separately and independently controlling each footplate member 109. In another embodiment, active foot support assembly 111 may include and/or consist essentially of one or more footplate member(s) 109 on which a user may stand and a corresponding motor for vibrating footplate member 109. Footplate member 109 may be configured as a cantilevered plate extend from base 17 and/or support structure 12 or alternatively may include support members or a lower surface that engages the ground, floor or other surface supporting transfer and training device 100. Such support members may either provide a static support with respect to the ground or may have wheels or casters to facilitate mobility of active foot support assembly 111 together with apparatus 100. Active foot support assembly 111 and its components may be integral with apparatus 100, detachably connected to apparatus 100 and/or retractably received within a cavity, space or hollow of base 17 and/or support structure 12. In another embodiment, active foot support assembly 111 may include a footplate base 107 positioned beneath and supporting footplate member 109. Footplate base 107 may be integral with or removably attached to footplate member 109. A lower surface of footplate base 107 may be in direct contact with the ground, providing stability and support for a patient standing atop of footplate member 109. Footplate base 107 may provide static support with respect to the ground or may optionally include casters or wheels on a lower surface thereof to facilitate mobility. Active foot support assembly 111 and its components may be integral with or detachably connected to apparatus 100, namely base 17 and/or support structure 12. In one embodiment, footplate member 109 and/or footplate base 107 may be retracted into a cavity, space or hollow of base 17 and/or support structure 12 for storage when not in use.

In an exemplary embodiment, the motor of active foot support assembly 111, operatively associated with footplate member 109, may be housed in a footplate base 107 or alternatively in support structure 12 and/or base 17. The footplate member 109 may be configured to vibrate at a relatively low frequency, for example, of between about 5 to about 40 Hertz and at an amplitude of between about 1 to about 5 mm. In one embodiment, the foot support assembly 111 is selectively controllable to vibrate footplate 109 at any selected frequency within a range of about 5 to about 40 Hertz and at any one of a selected amplitude between the range of about 1 to about 5 mm, either in a steady state of vibration frequency and/or amplitude or in a varying sequence to provide varying vibratory effects. In an exemplary embodiment, the motor of foot support assembly 111 and footplate 109 may be configured to vibrate at a frequency adapted to provide therapeutic activation of large muscle groups in a user's legs and/or torso effective to provide strength training, rehabilitate muscles and improve balance and/or posture. In another embodiment, the motor of foot support assembly 111 and footplate 109 may be configured to vibrate at a frequency adapted to therapeutically and effectively: prevent osteoporosis; reduce or reverse muscle atrophy; build and/or strengthen muscles, such as but not limited to pelvic muscles; improve muscle contraction; treat diseases of muscular origin; mitigate, improve and/or treat back pain; improve blood circulation; and improve and/or treat incontinence.

An active foot support assembly 111 together with the patient lift and transfer components of apparatus 100 assists not only in the treatment of a patient to regain the ability to stand and move around, but also in the activation of large muscle groups which can contribute to muscle toning and strengthening. The active foot support assembly 111 can also provide reflex based muscle stimulation and also body posture training. In all, the apparatus 100 can assist in building a patient's muscle strength, balance and improved body posture, in order to facilitate and optimise patient recovery and rehabilitation. In particular, the provision of an active foot support assembly 111 of the type shown in these Figures can be useful for any one or more of the following: training of muscle power/muscle force, after immobilization and injuries, prevention of osteoporosis, balance training and prevention of falls, coordination training, muscle atrophy, back pain, bad blood circulation, pelvic muscle training, stress-incontinency therapy, diseases of muscular origin, muscle contraction.

The patient transfer and training aid 100 may therefore help to reduce the length of a patient's stay in the hospital, reduce the duration of rehabilitation by assisting patients to becoming stronger and reduce the need for multiple attendees and/or professional physical therapists to deliver therapeutic strength and balance training. Apparatus 100 can allow a non-physiotherapist to train a patient, and both the sit to stand, vibration muscle building and balance training exercises can be part of a user's daily routine as is illustrated in FIGS. 3 to 8 and described in further detail below. As will become apparent, the patient is able to customize the different degrees of support required during and difficulty level of the rehabilitation training during a period of recovery and convalescence.

Apparatus 100 also includes a control unit 150 which can be controlled by the patient and is operatively associated with and coupled to the active foot support assembly 111 and/or lifting arm assembly 115, specifically to the motor units thereof. The control unit 150 includes any suitable user input allowing the user to control when to activate the foot support assembly 111 and the lifting arm assembly 115 and, where the activation can be regulated, to regulate this as desired. The control unit 150 may include a plurality of stored or storable exercise routines and sequences which can be selected by the patient as well as one of more control buttons, dials or other inputs enabling the patient to control the precise settings of the apparatus, for instance, not just whether the foot support assembly 116 is activated but also vibration frequency and/or amplitude of each footplate member 109. In one embodiment, it may be possible to independently control and customize the vibrational settings for two separate footplate members 109 and/or for different regions (e.g. left and right region) of a single footplate member 109. Controls may simultaneously and/or correspondingly pivotally move user arm supports 124 up, down or to the left and right.

Figure 4:
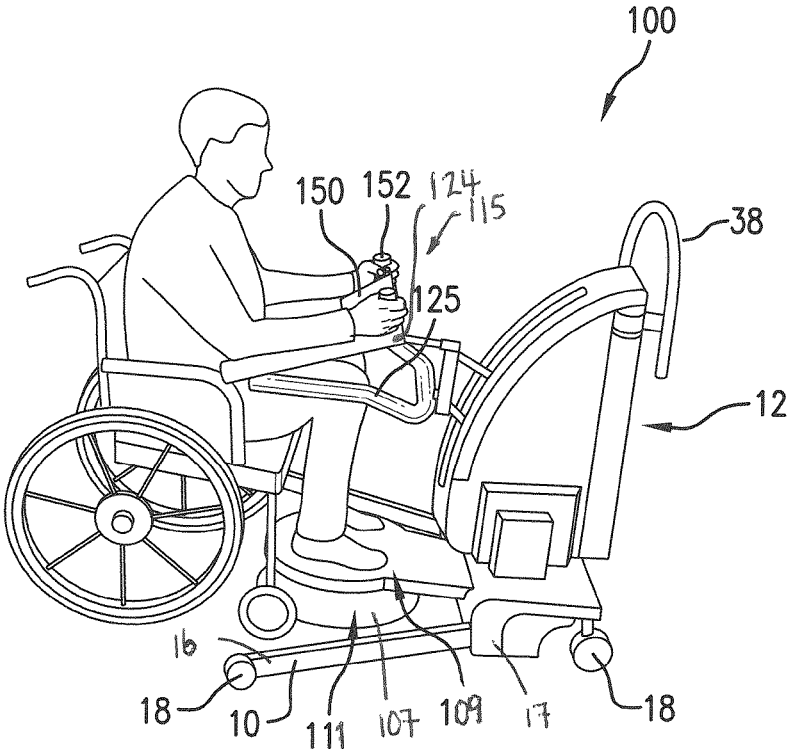
FIG. 4 is another perspective side view of the device of FIG. 3, showing a patient engaging the device when seated in in a wheelchair.

The apparatus 100 can provide a plurality of degrees of support to a patient during rehabilitation training, depending upon the strength and ability of the patient to balance. Examples are shown in FIGS. 3 to 8. Referring first to FIGS. 3 and 4, these show how the apparatus 100 can be utilized by a patient who is generally chair-bound. As will be apparent from FIGS. 3 and 4, the patient is able to place his/her feet on the active foot support assembly 116 and in such a manner as to be able to hold onto the handles 152 and control the control unit 150, in order to operate the active foot support assembly 116 to vibrate the footplate member 120 to provide muscle toning and exercising. It will be apparent in particular in FIG. 4 that the embodiment of assembly 100 shown has chassis members 10 which splay outwardly relatively to one another to allow access for a patient on a wheelchair. It will be appreciated that the foot support assembly 116 is fixed to the frame or chassis 10 by suitable struts or other fixation mechanisms.

Figure 5:
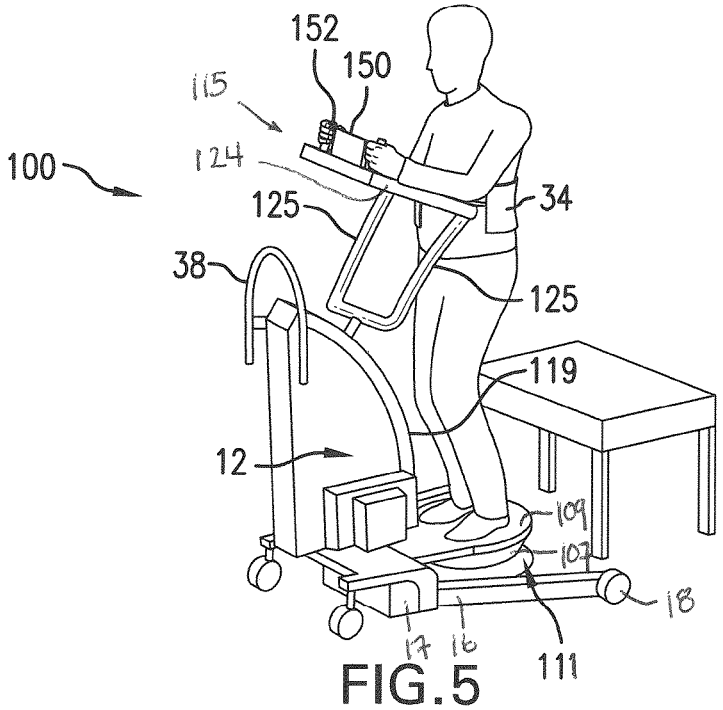
FIG. 5 is a perspective side view of the device of FIG. 3 showing the patient in a standing position on the footplate member, wherein the patient engages the hand grips of the device and is supported by a sling as he undergoes balance and muscle training.
Figure 6:
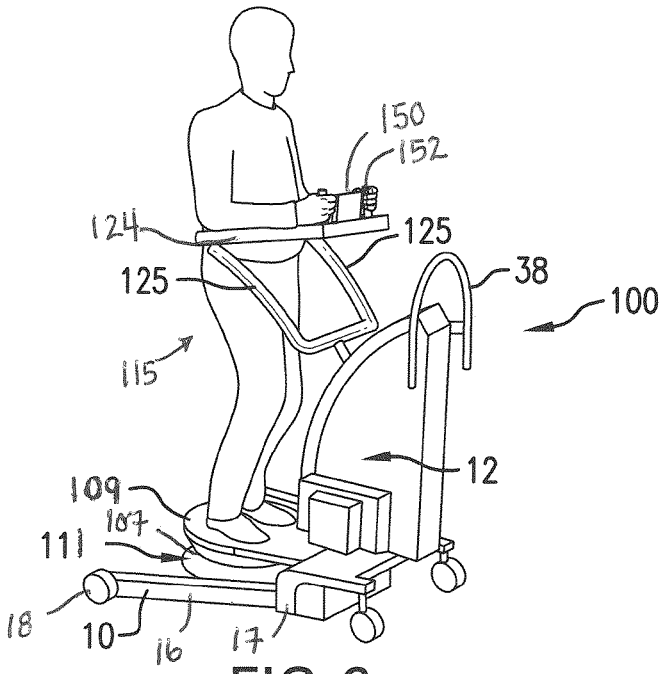
FIG. 6 is a perspective side view of the device of FIGS. 3 showing the patient in a standing position on the footplate member, wherein the patient engages the hand grips of the device as he undergoes balance and muscle training.

With reference to FIGS. 5 and 6, the patient shown in these Figures is more mobile and in particular able to stand from a sitting position, whilst holding onto the handles 152 fixed to the lifting arm assembly 125. In FIG. 5, the patient is supported also by a sling 34 which can be fixed to the lifting arm assembly 125 by suitable hooks or other fixing elements of a type which will be readily apparent to the skilled person. A patient may also remove the sling, as shown in FIG. 6, to further increase the level of difficulty during the balance and/or strength rehabilitation training. In this state, the patient is not only assisted in training to stand up again and to remain standing but also provides the additional toning and exercising via the active foot support assembly 111. The device 100 can be used in this configuration not only to provide the rehabilitation training but can also be used to transfer a patient from one location to another whilst supported on the device 100, in which case during patient transfer the active foot support assembly 116 can be deactivated as and when the patient desires. Deactivation can be effected by the patient or a caregiver via the control panel 150 or by a caregiver via a separate control input, not shown in the drawings but which can have a configuration and structure which will be immediately apparent to the skilled person. A caregiver control unit could be located, for example, on the upstanding part 12 of the device 100 or may be a remote control device.

Figure 7:
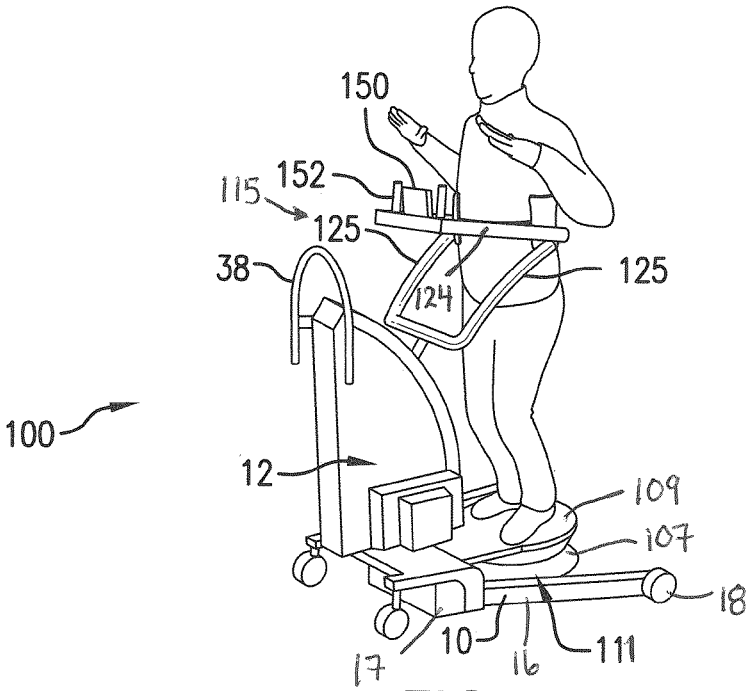
FIG. 7 is a perspective side view of the device of FIG. 3, showing the patient secured by a sling and in a standing hands free position on the footplate member while undergoing balance and muscle training.

In FIG. 7, the patient is able to participate in the muscle strengthening and balance training provided by active footplate assembly 111 without holding onto handles 152. As shown, sling 34 may be secured about the torso of the patient to provide support during the rehabilitation training.

Figure 8:
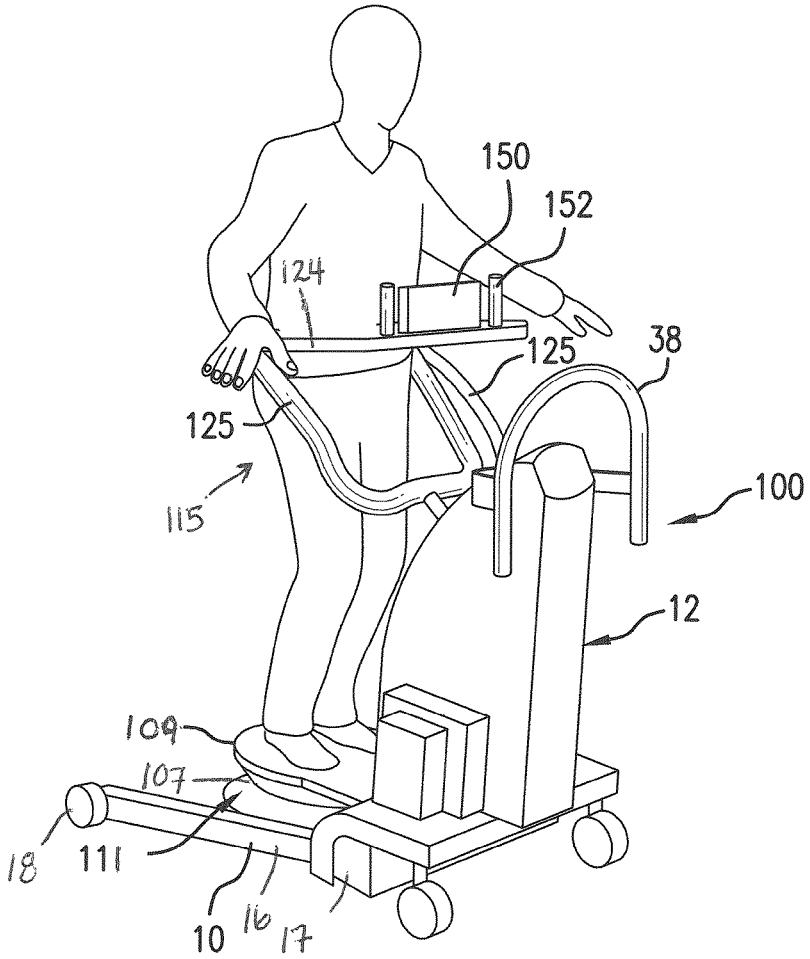
FIG. 8 is a perspective side view of the device of FIG. 3, showing the patient in a free standing position on the footplate member without any other support while undergoing balance and muscle training.

In FIG. 8 the device 100 is shown in the assistance of a more able patient and in particular a free standing patient who does not need to be supported by a sling 34 and who is able to remove his/her hands from the handles 152, in order to benefit exclusively from the toning and exercising provided by the active foot support assembly 116.

It will be readily appreciated that training and/or patient transfer can also be effected in other configurations intermediate those shown in FIGS. 3 to 8.

The teachings herein are not limited to the particular structures of apparatus shown in the drawings and described above and can be incorporated into a variety of patient handling and transfer devices including, for example, the ArjoHuntleigh Sara Combilizer™, Sara Plus™, Sara 3000™ and Sara Lite™ and Sara Stedy™ rehabilitation, standing, rising and/or transport devices.

In the embodiments described above, the foot support assembly 111 may be fixed to the device 100 so as to be an integral part of the device. It is envisaged also that the foot support assembly 116 could be of attachable form, for example to have fixing elements formed therewith, enabling the assembly 111 to be retrofitted to an existing patient transfer device. For instance, considering the example of FIGS. 1 and 2, the foot support 11 could be removed and replaced by the active foot support assembly 111 taught herein. In this manner, existing patient transfer devices can be modified to provide the additional functionality of the disclosed system.

The embodiments described above are given by way of example only and various modifications can be made by persons skilled in the art without departing from the scope of the present disclosure. For example, the transfer aid could be designed to be foldable for ease of storage and transport.

All optional features and modifications of the described embodiments and dependent claims are usable in all aspects of the disclosure taught herein. Furthermore, the individual features of the dependent claims, as well as all optional features and modifications of the described embodiments are combinable and interchangeable with one another.

The disclosure in the abstract accompanying this application is incorporated herein by reference.

The invention claimed is:

1. A patient transport and training device comprising:

a mobile chassis for transporting a user comprising at least one wheel, where the mobile chassis is configured to move along a surface using the at least one wheel;

a support structure extending upwards from the chassis;

at least one handle extending from the support structure for moving the device, the handle being operatively connected to a top end of the support structure opposite the chassis, wherein the handle is configured to be gripped by the user when the user is moving between a resting position and a standing position using the device, a foot support assembly comprising a powered footplate member which vibrates when actuated; and a control unit for actuating the foot support assembly to vibrate, wherein the control unit comprises a plurality of input elements provided on the at least one handle, in which the plurality of input elements are used to actuate a vibration of the foot support assembly.

2. The device according to claim 1, further comprising:

a powered lifting mechanism comprising at least one lifting arm assembly extending from the support structure and an actuator operable to raise and lower the at least one lifting arm assembly to assist in lifting the user from a seated to a standing position; and wherein the control unit also controls the power lifting mechanism.

3. The device according to claim 2, wherein the at least one lifting arm assembly comprises at least one lifting arm and a user arm support connected thereto.

4. The device according to claim 2, wherein the lifting arm assembly of the powered lifting mechanism comprises a first lifting arm and a second lifting arm both of which are pivotally connected to a user arm support, wherein the first lifting arm and the second lifting arm are arranged so as to move the user arm support from a first position in which the user arm support is upwardly inclined in an in use direction away from the user to be lifted to a second position in which the user arm support is substantially horizontal as the user arm support is raised by the lifting mechanism.

5. The device according to claim 2, wherein the at least one lifting arm assembly is pivotable about a first axis and a second axis, the first axis being substantially fixed and being further from a projecting end of the at least one lifting arm assembly than the second axis, wherein the actuator is configured to raise and lower the at least one lifting arm assembly.

6. The device according to claim 2, wherein the powered lifting mechanism defines a guide path extending generally upwardly in a direction away from the user being lifted.

7. The device according to claim 2, further comprising a sling connectable to the powered lifting mechanism to assist in raising the user from a seated position to a standing position.

8. The device according to claim 1, further comprising a retractable leg support extending laterally from the support structure and above the powered footplate member, wherein the leg support member is configured to abut a portion of a user's leg.

9. The device according to claim 1, wherein the powered footplate member is movably connected to the device, wherein the powered footplate member is moveable between a first position in which the powered footplate member is extended to support a user and a second position in which the powered footplate member is retracted within a space of at least one of the mobile chassis and the support structure for storage.

10. The device according to claim 1, further comprising a motor for driving the powered footplate member positioned within a space defined in part by at least one of the support structure and the mobile chassis.

11. The device according to claim 1, wherein the foot support assembly further comprises a footplate base and a motor for driving the powered footplate member, wherein the powered footplate member is connected to and positioned on the footplate base, and wherein the motor is at least partially located within at least one of the footplate base, the support structure, and the mobile chassis.

12. The device according to claim 1, wherein the foot support assembly further comprises a second powered footplate member commonly or separately driven from the powered footplate member.

13. The device according to claim 1, wherein the support structure is adjustable in length to suit the height of a user.

14. The device according to claim 1, wherein the mobile chassis comprises two legs each supporting a wheel at a front end and a rear end, the legs being spaced apart by a lesser distance at their rear ends than at their front ends to enable the rear ends of the legs to pass inside chair legs or a wheelchair.

15. A method for using the device of claim 1, wherein the method comprises:

activating the powered footplate to vibrate when the user's feet are positioned on the powered footplate member.

16. A method for using a transport and training device comprising a mobile chassis for transporting a user and a foot support assembly comprising a powered footplate member which vibrates when actuated, the method comprising:

using at least one wheel provided on the mobile chassis to move the device along a surface; and activating the powered footplate member with a plurality of input elements included in a control unit to vibrate when the user's foot is positioned on the powered footplate member, wherein the plurality of input elements is provided on at least one handle operatively connected to a support structure of the mobile chassis, the handle being operatively connected to a top end of the support structure opposite the mobile chassis, wherein the handle is configured to be gripped by the user when the user is moving between a resting position and a standing position using the device, in which the plurality of input elements are used to actuate a vibration of the foot support assembly.

17. The method of claim 16, further comprising inducing the powered footplate member to vibrate at a frequency between 5 to 40 Hertz and at an amplitude of between 1 to 5 millimeters.

18. The method of claim 16, wherein the user is seated in a chair adjacent to the device, the user's feet are positioned on the powered footplate member, and the user engages hand grips of the device when the powered footplate member is vibrating, the method further comprising raising the user from a sitting position to a standing position using a powered lifting mechanism of the device.

19. The method of claim 16, wherein the user stands on the powered footplate member while the powered footplate member is vibrating, the method further comprising supporting the user standing on the powered footplate member by securing a sling about a torso of the user.

20. The method of claim 19, further comprising transporting the user using a mobile device while the user is standing on the vibrating powered footplate member.

21. The method according to claim 16, wherein the control unit is provided on at least one handle of the mobile chassis.

* * * * *